US005770991A

United States Patent [19]

Baird

[11] Patent Number: 5,770,991

[45] Date of Patent: Jun. 23, 1998

[54] INDUCTOR WINDING WITH CONDUCTIVE RIBBON

[75] Inventor: Donald R. Baird, Sherman, Tex.

[73] Assignee: Texas Instruments Incorporated, Dallas, Tex.

[21] Appl. No.: 485,257

[22] Filed: Jun. 7, 1995

Related U.S. Application Data

[62] Division of Ser. No. 160,760, Dec. 3, 1993, Pat. No. 5,481,792, which is a division of Ser. No. 796,180, Nov. 22, 1991, Pat. No. 5,321,965.

[51] Int. Cl.[6] ..... H01F 22/30

[52] U.S. Cl. ..... 336/83; 336/206; 336/223; 336/232

[58] Field of Search ..... 336/232, 223, 336/200, 206, 225, 231, 205, 83; 310/268

[56] References Cited

U.S. PATENT DOCUMENTS

| | | | |
|---|---|---|---|
| 3,188,591 | 6/1965 | Dortort et al. | 336/223 |
| 3,419,834 | 12/1968 | McKechnie et al. | 336/232 |
| 3,848,210 | 11/1974 | Felkner | 336/200 |
| 4,310,821 | 1/1982 | Frances | 336/200 |
| 4,340,833 | 7/1982 | Sudo et al. | 310/268 |
| 4,482,874 | 11/1984 | Rubertus et al. | 336/232 |
| 4,578,654 | 3/1986 | Tait | 333/185 |

FOREIGN PATENT DOCUMENTS

| | | | |
|---|---|---|---|
| 267108 | 5/1988 | European Pat. Off. | 336/200 |
| 3-283404 | 12/1991 | Japan | 336/200 |
| 993265 | 5/1965 | United Kingdom | 336/200 |

*Primary Examiner*—Thomas J. Kozma
*Attorney, Agent, or Firm*—Richard L. Donaldson; Rene' E. Grossman

[57] ABSTRACT

There are provided low profile inductor and transformer windings, and methods for fabricating the same. An elongate conductive ribbon is wound in one continuous direction on a generally hourglass shaped mandrel to form the ribbon into a double conical helix having a plurality of spaced apart coils. A sheet of dielectric material having an orifice therethrough is threaded to the midpoint of the double conical helix. The two sides of the helix are then compressed into planes such that the coils in each side lie flat and engage the adjacent side of the sheet of dielectric material. A compound inductor winding can be fabricated from a continuous conductive ribbon wound into a plurality of double conical helixes joined end-to-end. After compression, the compound winding consists of a low profile stack of spiraled windings connected in series, but constituting only one continuous ribbon having no internal connections.

20 Claims, 3 Drawing Sheets

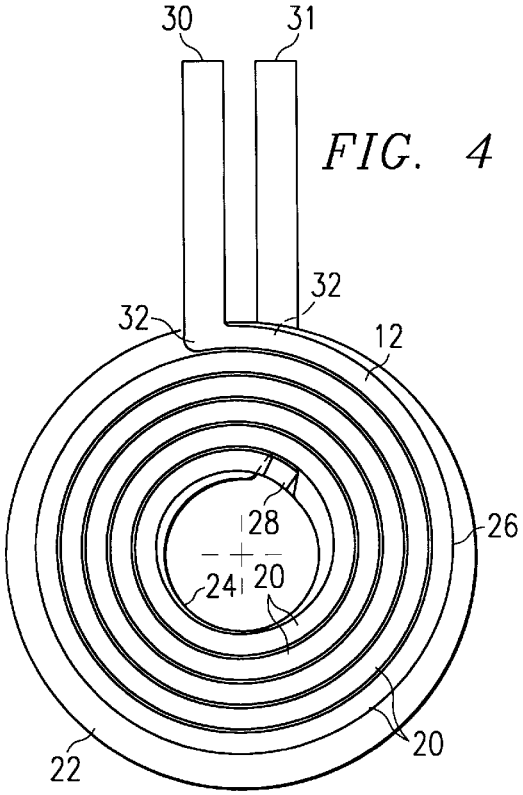
FIG. 4
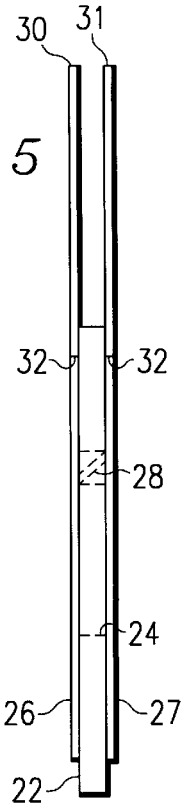
FIG. 5
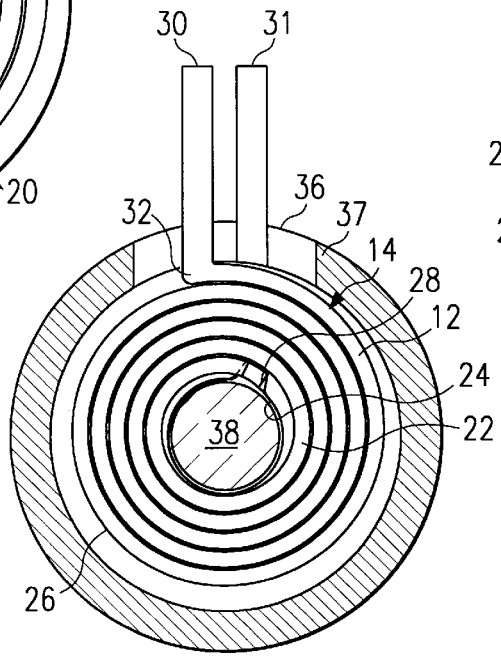
FIG. 6
FIG. 7
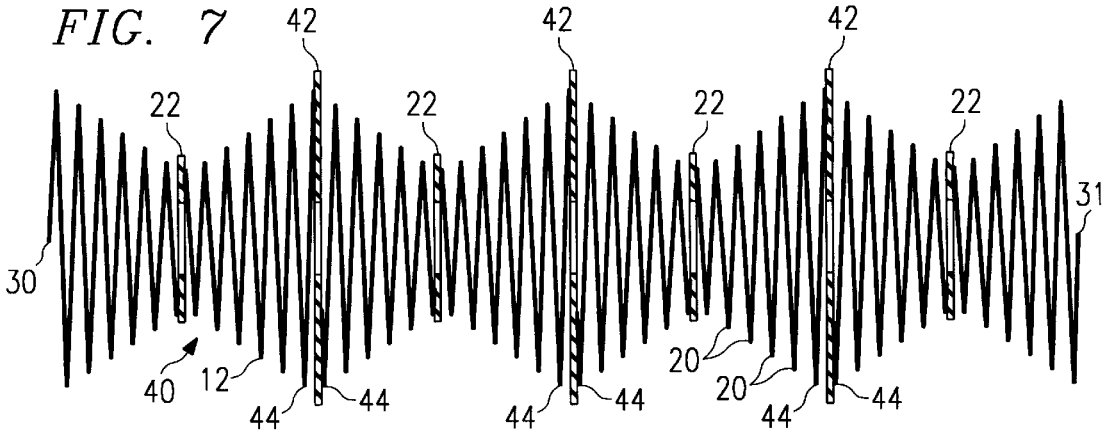

INDUCTOR WINDING WITH CONDUCTIVE RIBBON

This is a divisional of application Ser. No. 08/160,760 filed on Dec. 3, 1993, now U.S. Pat. No. 5,481,792 which is a divisional of application Ser. No. 07/796,180 filed on Nov. 22, 1991 which is now U.S. Pat. No. 5,321,965.

TECHNICAL FIELD OF THE INVENTION

The present invention generally relates to inductor and transformer windings and, more particularly, is concerned with inductor and transformer windings made from a continuous conductive ribbon and suitable for high efficiency, high current, but low profile power supplies.

BACKGROUND OF THE INVENTION

Modern electronic systems and particularly those using large scale integrated circuit technology require high efficiency, high current, and fast switching power supplies. At the same time, many applications for these electronic systems require that the power supplies be small and of low profile. Low profile packaging requires that as many components as possible be surface-mounted. Power supplies for such electronic systems invariably contain one or more inductors or transformers, which are often their physically largest components. Inductor and transformer size and shape, therefore, usually impose a constraint on reduction of the size and profile of a power supply. Conventional power supply inductors and transformers are large, bulky, and thus less than optimally compatible with surface mount technology and high density, low profile power supply packaging.

Previous attempts to reduce transformer and inductor coil profile, or height, have included the etching of copper windings directly onto a printed wiring board. However, because printed wiring board etchings are limited to material thicknesses of only 1 to 2 mils, these windings are very limited in current carrying capacity. Therefore, printed inductor and transformer windings have found very limited application, and are entirely unsuitable for modern, high current power supplies.

The high currents used in power supplies for modern, high density electronic systems also impose a reliability risk on power supply components. A particularly high risk resides in all integrated circuit or printed wiring board vias used to connect transformers or their internal windings to other components or to each other. A via is conventionally defined as a metal connection from a metallization layer to a conductive integrated circuit component or lower metal layer through an intervening layer of insulating material. Integrated circuit or printed wiring board vias are generally not capable of carrying high currents, and account for additional manufacturing costs.

Consequently, a need exists for small, low profile, high density, surface mounted inductor and transformer windings with a minimum number of internal and external connections through vias.

SUMMARY OF THE INVENTION

The present invention provides an inductor and transformer winding apparatus and method designed to satisfy the aforementioned need. Inductors and transformers having coils conforming to this invention have very low profile planar windings, and are thus compatible with high density, low profile power supply packaging. Having no internal connections or vias, they are highly reliable. Finally, their low profile geometry reduces magnetic path length and leakage inductance and increases inductor or transformer efficiency.

Accordingly, the present invention relates to apparatus and method for fabricating an inductor winding in which an elongate conductive ribbon is wound in one continuous direction on a generally hourglass shaped mandrel to form a double conical helix having two sides terminating in free ends and a plurality of spaced apart coils. A sheet of dielectric material having a concentric orifice therethrough is threaded onto the double conical helix so that the ribbon passes through the orifice near the point at which the two sides of the double conical helix meet. Each side of the helix is then compressed into a plane such that the coils in each side lie flat and engage the adjacent side of the sheet of dielectric material.

A compound inductor winding can be formed by winding an elongate conductive ribbon in one continuous direction on a compound mandrel to form a plurality of double conical helixes connected end-to-end, each double conical helix having two sides and a plurality of spaced apart coils. A first sheet of dielectric material having a concentric orifice therethrough is threaded onto each double conical helix to the point at which its two sides meet. A second sheet of dielectric material having a concentric orifice therethrough is inserted between the outermost coils of each adjacent pair of double conical helixes. The compound winding is then compressed so that the coils in each side of each double conical helix lie in a plane and engage on one side a first sheet of dielectric material, and on the other side a second sheet of dielectric material.

BRIEF DESCRIPTION OF THE DRAWINGS

For a more complete understanding of the present invention, and the advantages thereof, reference is now made to the following descriptions taken in conjunction with the accompanying drawings in which:

FIG. 4 is a plan view of the inductor winding of FIG. 3 after the sides of the winding have been compressed to lie flat against the sheet of dielectric material;

FIG. 5 is a side elevational view of the inductor winding of FIG. 4;

FIG. 6 is a sectional plan view of the inductor winding of FIG. 4 with a ferrite core post extending through the winding and a low profile, pot core shell enclosing the winding; and FIG. 7 is a conductive ribbon wound into a plurality of double conical helixes for use in fabricating a compound inductor winding in accordance with this invention.

DETAILED DESCRIPTION OF THE INVENTION

Figure 1:
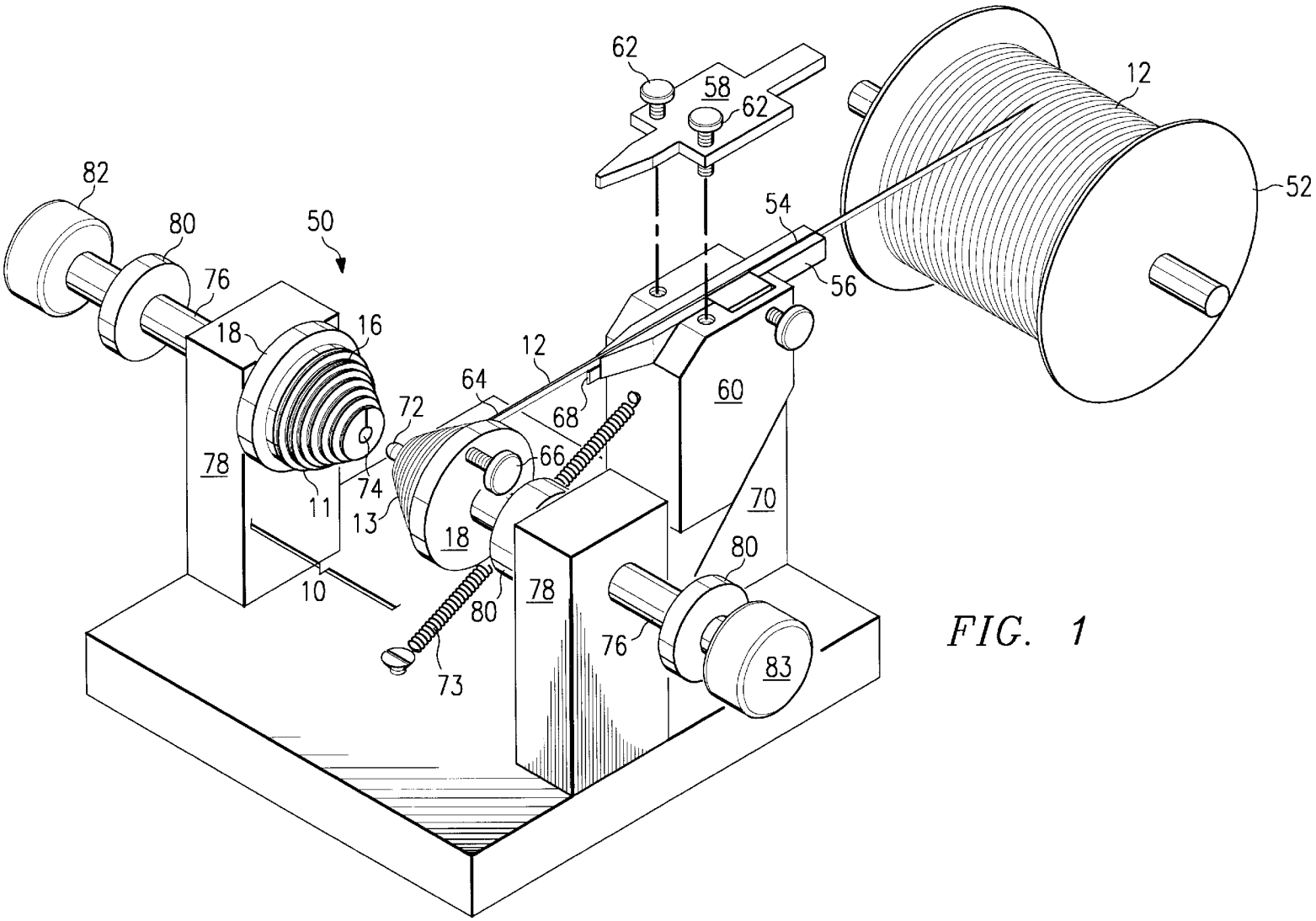
FIG. 1 is an exploded perspective view of a mandrel and fixture for fabricating an inductor winding in accordance with this invention.

The preferred embodiment of the present invention and its advantages are best understood by referring to the drawings, like numerals being used for like and corresponding parts of the various drawings.

In FIG. 1 there is shown an apparatus or fixture indicated generally as 50 which includes a mandrel 10 on which a conductive ribbon 12 can be wound into an inductor winding in accordance with the present invention. As seen in FIG. 1, mandrel 10 is a generally hourglass shaped member having two generally conical shaped halves 11 and 13 removably connected together. Each mandrel half 11 and 13 tapers inwardly toward the other mandrel half. When joined, the surfaces of mandrel halves 11 and 13 together define a continuous, double conical helix-shaped groove 16 beginning near the remote end of one mandrel half and terminating near the remote end of the other mandrel half. The groove 16 has a rectangular cross section and a width very slightly wider than the thickness t of ribbon 12. Mandrel 10 further includes cylindrical bases 18 attached to the opposed remote ends of each mandrel half 11 and 13. The diameter of each base 18 is slightly larger than the largest diameter of groove 16 in mandrel halves 11 and 13. Mandrel 10 is preferably made of stainless steel, or other smooth, nongalling material.

As seen in FIG. 1, mandrel half 13 includes an axially projecting pin 72 which mates with an axial hole 74 on mandrel half 11, for retaining mandrel halves 11 and 13 in axial alignment when they are connected. Shafts 76 extend axially from cylindrical bases 18 and rotate and are axially displaceable within supports 78. Each shaft 76 is provided with one or more annular stops 80 which are longitudinally adjustable along each shaft 76 for limiting the axial travel of shafts 76 within supports 78. In the illustrated embodiment, each shaft 76 is also provided with a knob 82 or 83 at its outer end for manually rotating the mandrel half 11 or 13 to which it is connected.

An inductor winding of this invention is wound utilizing fixture 50 in the following manner: a supply of conductive ribbon 12 is provided on a spool 52 behind fixture 50. Ribbon 12 may be made of any conductive, ductile metal, such as copper or aluminum. Oxygen free, fully annealed copper ribbon is preferred. Ribbon 12 has a width w substantially greater than its thickness t. Preferably, the width w is approximately five times thickness t, although the ratio of width w to thickness t may conceivably range from 1 to 20, depending on mechanical considerations and/or electrical parameters. Mechanical considerations affecting the optimum w/t ratio include, for example, build height and turns ratio. Electrical parameters affecting the optimum w/t ratio include electrical resistance, skin effect, and proximity effect, for example. Of course, the length 1 of ribbon 12 is substantially greater than either the width w or thickness t. typically by at least two orders of magnitude.

A length of ribbon 12 near the free end is inserted into a guide channel 54 in a ribbon guide 56. The width of guide channel 54 is slightly wider than the thickness t of ribbon 12, so that the thickness t of ribbon 12 is disposed horizontally in guide channel 54. Guide channel cover 58 is then secured to guide post 60, for example by thumb screws 62, to retain ribbon 12 in guide channel 54 as a winding is being wound. The free end 64 of ribbon 12 is secured within groove 16, in mandrel 10 by tightening thumb screw 66 so as to clamp ribbon 12 against the side wall (not illustrated) of groove 16. It is to be noted that ribbon 12 is positioned on edge, rather than its side, within groove 16, so that its thickness t is disposed horizontally, and its width w vertically, as it is wound. A guide blade 68 is inserted into groove 16 of mandrel 10 by sliding guide post 60 downward and forward with respect to guide post base 70. A tension spring 73 is used to bias guide blade 68 downward into sliding contact with groove 16 as mandrel 10 is rotated.

Mandrel half 11 is mated with half 13, and the entire mandrel 10 is rotated in this embodiment by rotating knob 82 counterclockwise as seen in FIG. 1. As mandrel 10 rotates, ribbon 12 is unwound from spool 52, guided by ribbon guide 56, and wound on its edge into double conical helical-shaped groove 16 on mandrel 10. Rotation of knob 82 with guide blade 68 disposed in groove 16 causes mandrel 10 and shafts 76 to translate axially to the right, as seen in FIG. 1.

When ribbon 12 has been wound to the remote end of groove 16 on mandrel half 11, ribbon 12 is cut a short distance from mandrel 10, and guide blade 68 is withdrawn from groove 16. Mandrel half 11 is then rotated clockwise slightly with respect to mandrel half 13 so as to create a short span in ribbon 12 between mandrel halves 11 and 13. Mandrel halves 11 and 13 are then axially separated slightly to form a small jog or axial offset in ribbon 12 where ribbon 12 spans mandrel halves 11 and 13. Mandrel half 11 is then rotated clockwise, and mandrel half 13 counterclockwise, to remove the inductor winding from mandrel 10.

Fixture 50 is a manual tool which illustrates how an inductor winding is wound according to the invention. Fixture 50 may be modified in several respects without departing from the spirit and scope of this invention. For example, although grooves 16 on mandrel halves 11 and 13, as illustrated, wind counterclockwise from their bases 18 toward their joined ends, their grooves could be formed to wind clockwise instead. Such a reverse wound mandrel would produce an inductor winding having a magnetic field with polarity opposite that of a winding wound on the illustrated mandrel 10. Fixture 50 may also be modified in other respects to increase production rate, increase product flexibility, and decrease labor costs. For example, the rotation and axial displacement of shafts 76 may be effected by appropriate motors and gearing; also, each different clamping, winding, feeding, separating and disengaging motion may be controlled by appropriate robotics.

Figure 2:
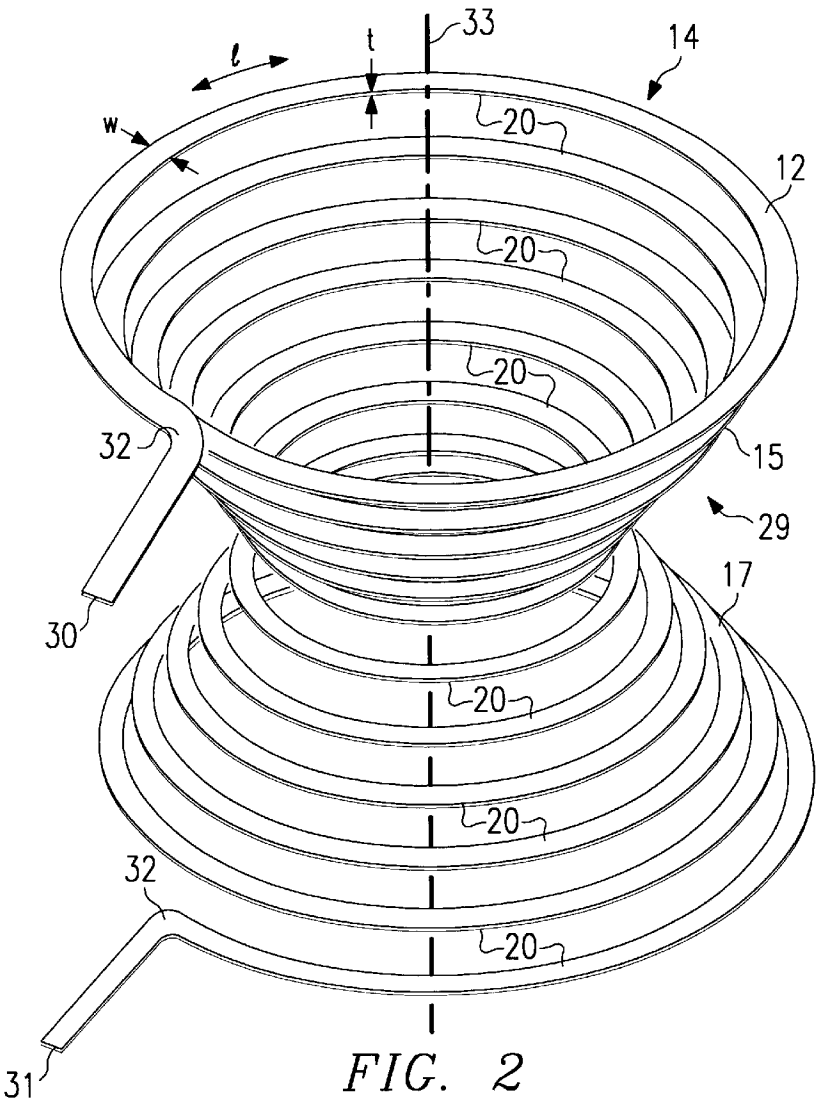
FIG. 2 is a perspective view of an inductor winding wound on the mandrel of FIG. 1.

In FIG. 2 is seen an inductor winding 14 that has been wound on mandrel 10. As seen, winding 14 initially forms a double conical helix 29 having two sides 15 and 17 terminating in respective free ends 30 and 31. In the illustrated embodiment, double conical helix 29 is disposed around a longitudinal axis indicated by dashed line 33. Each side 15 and 17 of double conical helix 29 has a plurality of spaced apart coils 20.

As seen in FIG. 2, ribbon 12 is wound such that width w is disposed in the planes of coils 20 and substantially perpendicular to axis 33, and such that thickness t is disposed parallel to the longitudinal axis 33 of winding 14. Bends 32 are formed in the outermost coil 20 of each side 15 and 17 so that the free ends 30 and 31 of ribbon 12 project radially from axis 33 for external connection.

Figure 3:
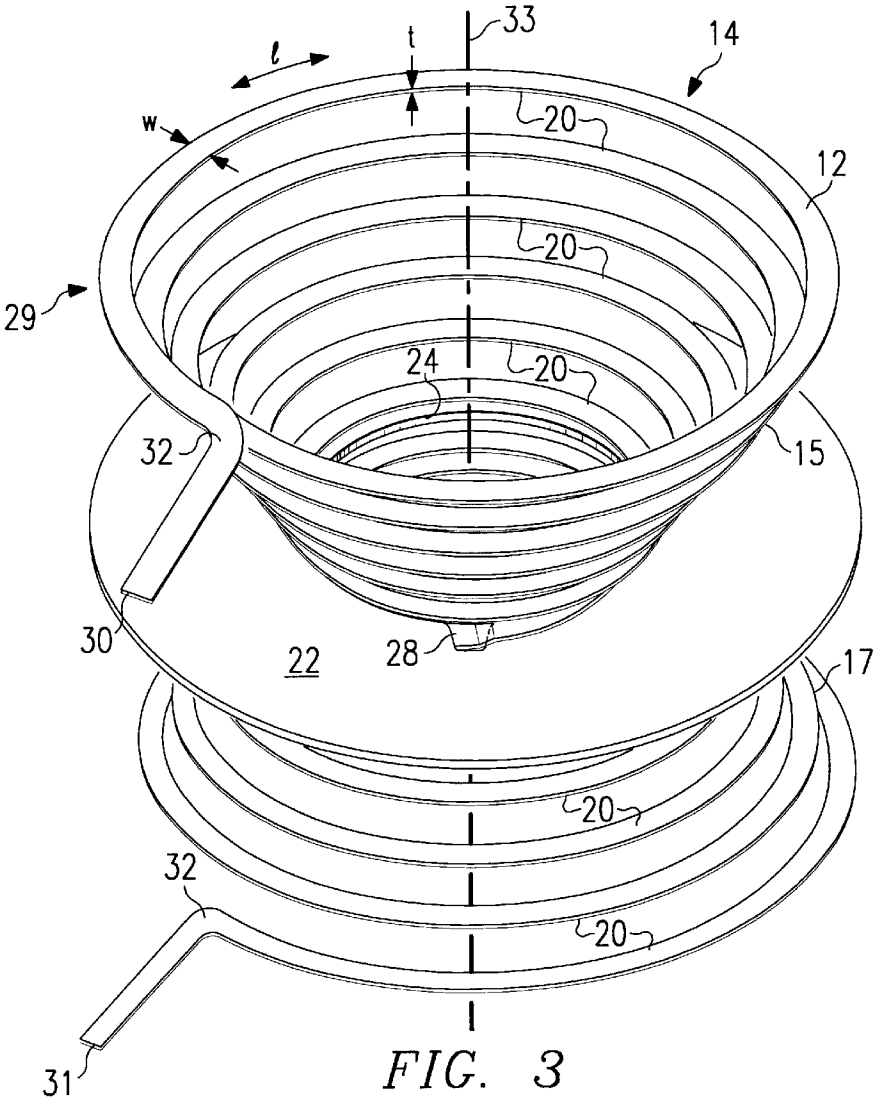
FIG. 3 is the inductor winding of FIG. 2 with a sheet of dielectric material threaded between the halves of the winding.

Turning now to FIG. 3, to fabricate an inductor winding by the method of this invention, a sheet 22 of dielectric material having a concentric hole or orifice 24 is threaded onto winding 14 so that winding 14 passes through orifice 24 near a point 28 at which the two sides 15 and 17 of double conical helix 29 meet. The sheet 22 of dielectric material preferably comprises Kapton dielectric, which is commercially available from Dupont Corporation. However, any similar polyimide material may be used for dielectric material sheet 22.

As seen in FIGS. 4 and 5, each side 15 and 17 of inductor winding 14 is then compressed into a plane such that the coils 20 in each side lie flat and engage one side of dielectric material sheet 22. The compressed sides 15 and 17 of winding 14 thus form flat, outward spirals 26 and 27, respectively, from point 28 at which the ribbon 12 passes through dielectric material sheet 22 to near ends 30 and 31, respectively, of ribbon 12. Sides 15 and 17 of double conical helix 29 are tapered such that, when compressed into spirals 26 and 27, respectively, coils 20 do not touch adjacent coils 20 to the interior or exterior. It should be noted that each side 15 and 17 of winding 14 spirals inward, crosses over through orifice 24 in dielectric material sheet 22, and spirals back outward without reversing the direction of winding. Thus, the magnetic fields produced by the two sides 15 and 17 of the winding 14 reinforce one another, rather their cancelling each other as they would if the direction of winding reversed at the midpoint of winding 14. It should also be noted that projecting ends 30 and 31 are on the outer coils 20, where attachment to other electrical components can readily be accomplished.

Spirals 26 and 27 may be adhered to sheet 22 of dielectric material by at least two methods. One method is to provide a sheet 22 of dielectric material that is coated on both sides with thermal set adhesive (not illustrated). After compression, winding 14 is heated sufficiently to activate the thermal set adhesive to adhere the coils 20 of spirals 26 and 27 to dielectric material sheet 22. Alternatively, spirals 26 and 27 may be adhered to sheet 22 by insulating adhesive tape (not illustrated) disposed between each spiral 26 or 27 and sheet 22.

In FIG. 6 there is shown a sectional plan view of an inductor winding 14 as described with reference to FIGS. 4 and 5, but further including a low profile, pot core shell 36 which partially encloses inductor winding 14. Bent ends 30 and 31 of ribbon 12 pass through a window 37 in pot core shell 36. FIG. 6 also illustrates a core post 38 extending through orifice 24 in dielectric materials sheet 22. Post 38 preferably comprises ferrite or ferromagnetic material, and serves as an inductor or transformer core. Top and bottom ends (not shown) of pot core shell 36 complete the enclosure of winding 14.

Referring to FIG. 7, a compound inductor winding 40 comprising a plurality of inductor windings 14 wound end-to-end can also be fabricated from a continuous conductive ribbon 12 by the method of this invention. The compound mandrel on which a compound winding 40 can be wound (not illustrated) comprises a plurality of hourglass shaped members, each similar to that illustrated in FIG. 1, but connected end-to-end. The conductive ribbon 12 is wound in one continuous direction on the compound mandrel to form a compound inductor winding 40 having a plurality of double conical helixes joined end-to-end. A sheet 22 of dielectric material having a concentric orifice therethrough is then threaded to the midpoint of each double conical helix in a manner similar to that described above with reference to inductor winding 14. Sheets 42 of dielectric material having concentric orifices therethrough are inserted between the outermost coils 44 of adjacent pairs of double conical helixes in compound winding 40. Compound winding 40 is then axially compressed so that the coils in each side of each double conical helix lie in a plane. With the exception of the outermost coils, the compressed coils engage on one side a sheet 22 of dielectric material, and on the other side a sheet 42 of dielectric material. Bends (not illustrated) are formed in the ribbon 12 near the ends 30 and 31 so that ends 30 and 31 project radially from compound winding 40, for external connection.

The coils of compound winding 40 may be adhered to dielectric material sheets 22 and 42 by either thermal set adhesive applied to the sheets or by insulating adhesive tape, in the manner described earlier with reference to inductor winding 14. A ferromagnetic or ferrite core post (not illustrated) is then inserted through the holes in the sheets 22 and 42 of dielectric material and through the coils 20 of compound inductor winding 40 for constituting an inductor or transformer core. Compound winding 40 may also be partially or fully enclosed within a low profile, pot core shell (not illustrated) having an inner diameter slightly larger than the outer diameter of compound winding 40.

Inductor winding 14 and compound inductor winding 40 of this invention have a variety of applications. For example, windings 14 and 40 can be used alone as inductor coils. Alternatively, windings 14 or 40 can be interleaved in a variety of configurations to form low profile, yet high efficiency multi-coil transformers.

Inductor coils and transformers made in accordance with this invention have several distinct advantages over those of the prior art. First, inductor coils and transformers of this invention are small and of very low profile, and are thus highly compatible with high density, low profile power supply packaging. Second, they are suitable for surface mounting, yet their windings have no internal connections or vias to jeopardize mechanical and thermal reliability. Third, the core path and magnetic path lengths of a transformer made according to this invention are very short in comparison with transformers of conventional geometry. The shorter magnetic path length reduces leakage inductance and core heating, and thus enhances transformer efficiency. Fourth, transformers utilizing planar primary windings made according to this invention can be interleaved with similarly wound planar secondary or other windings, resulting in closer magnetic coupling and reduced leakage inductance, which enhances efficiency and other desirable switching power supply characteristics. Finally, the induced magnetic fields are contained within the low profile pot core shell, which further enhances efficiency.

The present invention, and many of its intended advantages, will be understood from the foregoing description and it will be apparent that, although the invention and its advantages have been described in detail, various changes, substitutions, and alterations may be made in the manner, procedure, and details thereof without departing from the spirit and scope of the invention, as defined by the appended claims, or sacrificing all of its material advantages, the form hereinbefore described being merely a preferred or exemplary embodiment thereof.

What is claimed is:

1. An inductor winding, comprising:

(a) a sheet of dielectric material having first and second opposed sides and an orifice formed to extend between the first and second sides;

(b) a single continuous elongate conductive ribbon having first and second ends and a point substantially remote from the first and second ends, the ribbon having a width substantially greater than its thickness, the ribbon forming first and second flat spirals from said point to respective ones of said first and second ends, each flat spiral substantially disposed in a plane, each spiral having at least one coil, the first spiral being disposed on the first side of the sheet of dielectric material, the second spiral being disposed on the second side thereof, and said point substantially remote from the first and second ends disposed proximate the orifice, the width of the ribbon being substantially disposed in the planes of the spirals, and the thickness of the ribbon being disposed perpendicular to the planes of the spirals.

2. The inductor winding of claim 1, wherein the conductive ribbon comprises metal.

3. The inductor winding of claim 1, wherein the width of the ribbon is at least equal to its thickness, but is not greater than twenty times its thickness.

4. The inductor winding of claim 1, further including a layer of thermal set adhesive applied to at least one side of the sheet of dielectric material for adhering the spiral disposed on said at least one side to the sheet of dielectric material.

5. The inductor winding of claim 1, further including at least one piece of insulating adhesive tape disposed between each spiral and the sheet of dielectric material, for adhering the spirals to the sheet of dielectric material.

6. The inductor winding of claim 1, wherein each spiral has a plurality of coils including an outermost coil, the ribbon in the outermost coil of at least one of the spirals being bent so that the free end of the ribbon projects radially from the spiral for exterior connection.

7. The inductor winding of claim 1, further including a ferrite core post extending through the orifice in the sheet of dielectric material and through the spirals of the winding.

8. The inductor winding of claim 1, further including a pot core shell at least partially enclosing the inductor winding.

9. The inductor winding of claim 1, wherein said point substantially remote from the first and second ends of the ribbon is approximately the midpoint thereof.

10. The inductor winding of claim 1, wherein the inductor winding is a transformer winding.

11. A compound inductor winding, comprising:

(a) a plurality of first sheets of dielectric material, each first sheet having opposed sides and an orifice formed to extend between the sides;

(b) a single continuous elongate conductive ribbon having opposed first and second ends, the ribbon having a width substantially greater than its thickness, the ribbon passing through the orifice in each of the first sheets of dielectric material;

(c) for each orifice, the ribbon forming a pair of flat, outward spirals extending from the point at which it passes through the orifice, each spiral having at least one coil and being substantially disposed in a plane and on a respective side of a first sheet of dielectric material, the width of the ribbon being substantially disposed in the planes of the spirals, and the thickness of the ribbon being disposed perpendicular to the planes of the spirals.

12. The compound inductor winding of claim 11, further including a plurality of second sheets of dielectric material having opposed sides and an orifice formed to extend between the sides, each spiral disposed between a side of a first sheet of dielectric material and a side of a second sheet of dielectric material.

13. The compound inductor winding of claim 11, wherein the conductive ribbon comprises metal.

14. The compound inductor winding of claim 11, wherein the width of the ribbon is at least equal to its thickness, but is not greater than twenty times its thickness.

15. The compound inductor winding of claim 11, further including a layer of thermal set adhesive applied to at least one side of each first and second sheet of dielectric material, for adhering the spirals to adjacent first and second sheets of dielectric material.

16. The compound inductor winding of claim 11, further including at least one piece of insulating adhesive tape disposed between each spiral and the sheet of dielectric material adjacent thereto, for adhering the spirals to the adjacent sheet of dielectric material.

17. The compound inductor winding of claim 11, wherein each spiral has a plurality of coils including an outermost coil, the ribbon in the outermost coil of at least one of the outermost spirals being bent so that the free end of the ribbon projects radially from the spiral, for exterior connection.

18. The compound inductor winding of claim 12, further including a ferrite core post extending through the orifices in the first and second sheets of dielectric material and through the spirals in the winding.

19. The compound inductor winding of claim 18, further including a cylindrical, pot core shell at least partially enclosing the compound inductor winding.

20. The compound inductor winding of claim 11, wherein the compound inductor winding is a transformer winding.

* * * * *